US009499966B2

(12) United States Patent
Darnell

(10) Patent No.: US 9,499,966 B2
(45) Date of Patent: Nov. 22, 2016

(54) INTERNALLY VENTED TOILET WITH DEDICATED EXHAUST SYSTEM

(71) Applicant: Wayne Darnell, Santa Fe, NM (US)

(72) Inventor: Wayne Darnell, Santa Fe, NM (US)

( * ) Notice: Subject to any disclaimer, the term of this patent is extended or adjusted under 35 U.S.C. 154(b) by 142 days.

(21) Appl. No.: 14/588,203

(22) Filed: Dec. 31, 2014

(65) Prior Publication Data

US 2016/0186420 A1 Jun. 30, 2016

(51) Int. Cl.
*E03D 9/05* (2006.01)

(52) U.S. Cl.
CPC ..... *E03D 9/05* (2013.01)

(58) Field of Classification Search
CPC ..... E03D 9/05; E03D 9/052
USPC ..... 4/352, 348, 216
See application file for complete search history.

(56) References Cited

U.S. PATENT DOCUMENTS 1,213,113 A * 1/1917 Lange ..... E03D 9/052 4/217
1,401,091 A 12/1921 Lucas
1,563,691 A * 12/1925 De Cola ..... E03D 9/052 4/352
1,931,052 A 10/1933 Baither
1,955,579 A 4/1934 Malaussene
2,079,733 A 5/1937 Cummings
2,172,506 A 9/1939 Gerger
2,297,035 A 9/1942 Svec
2,452,282 A 10/1948 Auer
2,724,840 A 11/1955 Scott et al.
2,726,405 A 12/1955 Smith et al.
2,728,921 A 1/1956 Dorko
2,743,462 A 5/1956 McMillan
3,020,564 A 2/1962 Chodacki et al.
3,064,274 A 11/1962 Gleason
3,069,696 A 12/1962 Howell
3,277,499 A 10/1966 Keefauver
3,332,089 A 7/1967 Wilton
3,386,109 A 6/1968 Christian et al.
3,491,382 A 1/1970 Poister
3,501,784 A 3/1970 Maisch
3,571,822 A 3/1971 Shaw, Jr
3,703,010 A 11/1972 Russell
3,763,505 A 10/1973 Zimmerman
3,790,970 A 2/1974 Bendersky et al.

(Continued)

FOREIGN PATENT DOCUMENTS

KR 10-2004-0042754 5/2004

OTHER PUBLICATIONS

PCT International Search Report for PCT/US2015/067579 dated Jun. 3, 2016.

*Primary Examiner* — Huyen Le
(74) *Attorney, Agent, or Firm* — Kevin Soules; Luis M. Ortiz; Kermit D. Lopez

(57) ABSTRACT

This invention pertains to an internally exhausted toilet bowl which employs basic principles of fluid flow to provide reliable, more efficient, and more effective removal of noxious toilet odors while reducing energy consumption when compared to current art. This is accomplished during all conditions of normal operation. In case of toilet overflow or condensate buildup, the impact on the vent exhaust path from these upset conditions can be resolved easily, and normal operation can be restored without damage to any components. Additionally, this invention includes maintenance features that would provide means for back flushing the annulus vent line and orifices if clogging ever were to occur.

14 Claims, 7 Drawing Sheets

(56) References Cited

U.S. PATENT DOCUMENTS

| | | | | |
|---|---|---|---|---|
| 3,805,304 | A | 4/1974 | Ikehata | |
| 3,902,203 | A | 9/1975 | Poister et al. | |
| 4,017,916 | A | 4/1977 | Pearson | |
| 4,133,060 | A | 1/1979 | Webb | |
| 4,590,629 | A | 5/1986 | Lusk | |
| 4,620,329 | A | 11/1986 | Wix | |
| 4,893,359 | A | 1/1990 | Vu et al. | |
| 4,993,083 | A | 2/1991 | Lemieux | |
| 5,161,262 | A | 11/1992 | Quaintance, Sr. | |
| 5,193,227 | A | 3/1993 | Crowley, Jr. | |
| 5,231,705 | A | 8/1993 | Ragusa | |
| 5,369,812 | A | 12/1994 | Trombley | |
| 5,671,484 | A | 9/1997 | Lee, III | |
| 5,727,263 | A | 3/1998 | Hugo Ceja Estrada | |
| 5,809,581 | A | 9/1998 | Brown | |
| 5,819,324 | A | 10/1998 | Bianco | |
| 5,850,638 | A | 12/1998 | Her | |
| 5,906,009 | A | 5/1999 | Sakar | |
| 5,930,844 | A | 8/1999 | Scott, III | |
| 6,082,979 | A | 7/2000 | Friedman | |
| 6,237,163 | B1 * | 5/2001 | Guzzo | A47K 13/307 4/213 |
| 6,260,214 | B1 | 7/2001 | Smith | |
| 6,295,656 | B1 | 10/2001 | Tillen | |
| 6,351,855 | B1 | 3/2002 | Allen | |
| 6,363,542 | B1 | 4/2002 | Pope, Sr. | |
| 6,496,986 | B1 | 12/2002 | Lumsden | |
| 6,519,786 | B1 | 2/2003 | Francis | |
| 6,526,598 | B1 | 3/2003 | Black | |
| 6,550,072 | B1 | 4/2003 | Ware | |
| 6,553,581 | B1 | 4/2003 | Lee | |
| 6,567,994 | B1 | 5/2003 | Spurr et al. | |
| 6,678,900 | B2 | 1/2004 | Ware | |
| 6,694,534 | B2 | 2/2004 | Stone | |
| 6,749,805 | B2 | 6/2004 | Parkhurst et al. | |
| 6,760,928 | B1 | 7/2004 | Rodriguez | |
| 6,772,449 | B1 | 8/2004 | Wolfe | |
| 6,804,837 | B1 | 10/2004 | Guess, Sr. | |
| 6,928,666 | B1 | 8/2005 | Schaffer | |
| 6,983,491 | B2 | 1/2006 | Curtis et al. | |
| 7,117,548 | B1 | 10/2006 | Reyes | |
| 7,331,066 | B1 | 2/2008 | Ramos | |
| 7,376,982 | B1 | 5/2008 | Pencheon | |
| 7,730,560 | B2 | 6/2010 | Markaj | |
| 8,060,952 | B2 | 11/2011 | Shaul | |
| 8,151,377 | B2 | 4/2012 | Pickle | |
| 8,196,232 | B2 | 6/2012 | Van Herp et al. | |
| 2002/0112279 | A1 | 8/2002 | Van Niekerk | |
| 2007/0289053 | A1 | 12/2007 | Tolbert | |
| 2011/0078849 | A1 | 4/2011 | Palazzola | |
| 2011/0088156 | A1 * | 4/2011 | White | E03D 9/052 4/348 |
| 2011/0099697 | A1 | 5/2011 | Weigart | |

* cited by examiner

INTERNALLY VENTED TOILET WITH DEDICATED EXHAUST SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

Technical Field

The present invention relates to an odor-eliminating apparatus. More specifically, an embodiment of the present invention involves a toilet ventilation exhaust system that employs a dedicated, internal, orificial, annular vent passage integral to the upper rim of the toilet bowl. When connected to an appropriate exhaust line and vent exhaust fan, this system effectively and efficiently eliminates toilet odors. This invention functions during normal operation and offers provisions for recovery from upset conditions of condensate buildup and overflow as well as for periodic maintenance if vent exhaust path clogging ever were to occur.

Current art toilets depend on a ceiling ventilation exhaust fan to remove bathroom odors which originate in the toilet. Many of the more noxious gases are considerably heavier than air so a prolonged ventilation period using the ceiling exhaust fan method is necessary to exhaust toilet odors. This process is inefficient and ineffective as the gases must exit the toilet and enter the room air space before being exhausted. This non-direct exhaust flow path makes the odorous gases susceptible to mixing with other air and to being carried into areas outside the toilet room, thus causing the exhaust fan to operate for an extended period of time to remove all odors and often ineffectively. Since current art ceiling exhaust fans generally operate at 1.42-3.12 cubic meters per minute (50-110 cubic feet minute), literally scores of cubic meters (hundreds or thousands of cubic feet) of air are removed by prolonged operation of the fan before the toilet odors are eliminated from the toilet and surrounding air space. This air generally is conditioned (i.e., heated or cooled), and continued exhaust flow will result in pulling more outside, unconditioned air into the home or building. Sustained exhaust fan operation and the need to condition excessive replacement air cause unnecessary operation of building exhaust and heating, ventilating, and air conditioning systems, thus demanding unnecessary energy consumption when compared to the proposed invention. Additionally, the current art exhaust fans often include a light which is energized when the exhaust fan is energized using the same on/off switch. Daytime use of the light may be an additional waste of energy.

Some have attempted to address the problem by employing the use of the existing rim jet ports for gaseous odor removal. Sharing of common vent/flow ports for both noxious air exhaust and flushing water would require cycling of the exhaust fan to reestablish the exhaust flow after flushing. Otherwise, the continuing ventilation exhaust flow will establish and maintain a small standing column of water in the vent/flow ports equal in height (in millimeters or inches) to the suction pressure of the exhaust fan and will prevent subsequent exhaust air flow. During this period there will be no further exhaust flow from the toilet, and noxious odors will escape from the toilet and into the surrounding area. This cycling of exhaust fan operation to eliminate this concern makes such arrangements in a single residence inconvenient. It is impractical or unworkable for such arrangements in a larger building with multiple toilets and a common exhaust ventilation system which cannot be cycled off then on after every individual flush. Additionally, using the same rim jet holes for both water and air flows will result in cyclical wetting and drying of the small diameter ports. This ultimately will clog these ports due to normal presence of soluble solids in the water. In such cases neither the flush water flow nor exhaust air flow will be maintained without frequent maintenance to keep the rim jet ports clear. This is not a workable approach to toilet operation or odor removal. Therefore, an aspect of the present invention which provides for a separate flow path for water introduction into the toilet bowl and a separate flow path for odor removal is necessary to maintain reliable and efficient toilet operation for both flushing and odor removal.

The toilet system of U.S. Pat. No. 5,727,263 discloses two separate flow paths with two separate exhaust fans, each servicing a separate exhaust path. In the event of toilet overflow or condensate buildup in the exhaust path, the fan motors, which are below toilet bowl level, would fail due to water intake and would require replacement. There is no design provision for drainage of condensate or overflow liquid on the upstream or downstream side of each exhaust fan. There is no provision for performing maintenance which may require unclogging or removing water in the vent exhaust path or performing other required cleaning of the vent exhaust path which may occur over time. There is no specified consideration for factors of vent exhaust orifice sizing, exhaust ventilation piping size, vent exhaust flow rate, or capillary action relating to fan performance capabilities.

The toilet system of U.S. Pat. No. 5,809,581 discloses a system without toilet overflow or condensate buildup remedies. There is no recovery of the system due to overflow or condensate buildup without excavating the floor to remove the liquid filled exhaust piping which slopes downward from the toilet rim and is buried into the floor below the toilet. This resulting water column would block vent exhaust air flow, deprive the exhaust fan of air flow and cause exhaust fan failure and loss of vent exhaust flow. Consistent with the first deficiency, there is no element for draining any part of the vent exhaust path. There is no element for performing maintenance which may require unclogging of the vent exhaust path or performing other required cleaning of the exhaust pathway which may occur over time. There is no teaching of vent exhaust orifice sizing, exhaust ventilation piping size, vent exhaust flow rate, or capillary action relating to fan performance capabilities. There is no stated consideration for location of the exhaust fan with respect to concern for condensate buildup or toilet overflow condition. Drawings show the vent exhaust orifices smaller than the liquid rim jet flush orifices. While the drawings are not stated to be to scale, the air vent holes would be larger than the liquid rim jet orifices to achieve adequate air flow and avoid capillary action concerns.

U.S. Pat. No. 7,331,066 discloses a toilet system with a non-collapsible, flexible, hollow tube running throughout the upper rim duct in contrast to the wholly integrated but separate casting of the annular exhaust passage described herein. The flexible, hollow tube running throughout the upper rim duct of U.S. Pat. No. 7,331,066 would reduce the otherwise available cross-sectional area of the liquid, upper rim duct, create turbulence, and impede liquid flow through the upper rim duct. The airflow means/air exhaust mechanism disclosed in U.S. Pat. No. 7,331,066 can be any selection of suction blower, vacuum pump, or exhaust fan. Also, a high pressure suction created by a vacuum pump or suction blower would exacerbate orifice clogging, jeopardize the function of the air exhaust mechanism due to the possibility of pulling water into these mechanisms with condensate buildup or toilet overflow, and would exacerbate efforts to perform effective back flushing of the vent exhaust passageways due to high suction pressures pulling in possible contaminants into the vent exhaust orifices. Some aspects of these concerns could be mitigated by the pressure switch which would turn off the exhaust mechanism when the user leaves the toilet, but upon subsequent usage of the toilet, failure of the system to function would be likely. There is no element for maintenance back flushing or cleaning. This connection between the vent exhaust orifices and the non-collapsible, flexible, hollow tube is a very restrictive flow path to the flexible, hollow tube and makes questionable the ability to provide adequate exhaust air flow. There is no provision to accommodate condensate buildup or toilet overflow. This could result in fan (or other exhaust mechanism) failure and cessation of function of the vent exhaust system. There is no consideration of capillary action. Capillary action could be significant due to the very restrictive flow paths shown between the vent exhaust orifices and the non-collapsible, flexible, hollow tube.

All of the aforementioned systems suffer from the same deficiency of permitting condensate or overflow conditions into the vent pathway whereby the water would block the evacuation of the fumes in the pathway.

The references do not address the upset conditions of condensate buildup or of toilet overflow which subsequently may render many of the other known systems to be non-functional. An embodiment of the present invention provides for features which would allow recovery without equipment damage from toilet overflow and condensate buildup. Embodiments of the present invention also permit maintenance back flushing to clear the annular vent passage, vent exhaust orifices, annular exhaust vent line, and parent exhaust line if clogging of the exhaust ventilation flow path were to occur for any reason over the lifetime of operation.

BRIEF SUMMARY OF THE INVENTION

One embodiment of the present invention provides a toilet system comprising a toilet bowl having a rim jet annulus located circumferentially inside a portion of a rim disposed above and around the periphery of the toilet bowl wherein the rim jet annulus has a plurality of rim jet orifices for introducing water into the toilet bowl. An annular vent passage which is separate from the rim jet annulus is located circumferentially inside and concentric with the rim jet annulus of the toilet rim of the toilet bowl. The annular vent passage has a plurality of vent exhaust orifices located at the inner radius of the annular vent passage and positioned above the rim jet orifices to avoid communication of the water from the rim jet orifices into the annular vent passage via the vent exhaust orifices. According to another embodiment, the annular vent passage is predominantly located above the existing rim jet annulus. In either embodiment, the annular vent passage connects to an annular exhaust vent line at the back vertical plane of the toilet bowl to avoid interference with the rim jet annulus. The annular exhaust vent line slopes downward from the back vertical plane of the toilet bowl to a low point where there is located a low point drain line and a low point drain valve at the bottom of the low point drain line. The annular exhaust vent line continues with a constant slope upward for a distance to join with an enlarged parent exhaust line. The parent exhaust line is in communication with a bypass branch line upstream of a vent exhaust fan upstream isolation valve located upstream of a vent exhaust fan and the parent exhaust line. The annular exhaust vent line may exit the toilet bowl at a same elevation as the annular vent passage or may exit the toilet bowl below the toilet rim from inside the toilet bowl to avoid interference with the rim jet annulus flow path. For example, the vent exhaust orifices are sized in consideration for vent exhaust flow and capillary action consistent with the vent exhaust fan.

In a further embodiment, the bypass branch line tees off the parent exhaust line upstream of the vent exhaust fan upstream isolation valve and at a minimum elevation more than the sum elevations of the toilet rim plus the maximum suction pressure of the vent exhaust fan. Alternatively, the bypass branch line further comprises a branch line isolation/throttle valve which may be used for throttling of air flow or for throttling or isolating liquid flow for maintenance back flush operations. In yet another embodiment, the bypass branch line does not include a branch line isolation/throttle valve. The bypass branch line is sized to allow sufficient and continuous ventilation flow for the vent exhaust fan under normal and upset conditions to maintain exhaust flow through the vent exhaust orifices with the bypass flow and to serve as a maintenance access connection for back flushing the parent exhaust line, annular vent passage, and vent exhaust orifices.

In one embodiment, a single fan is used with a system as described herein to create a suction at the plurality of vent exhaust orifices of the annular vent passage of the toilet when one or more toilets are connected to the same parent exhaust line.

According to one embodiment, the upward slope of the annular exhaust vent line and parent exhaust line of a system as describe herein is at least 3 millimeters per 0.3 meters of piping from the low point drain line.

According to another embodiment, the low point drain line located at the low point of the annular exhaust vent line of the system described extends to a length which is greater than the height of the water column equivalent to the maximum suction pressure possible from the vent exhaust fan to ensure positive drainage under all use conditions, and the low point drain line and the low point drain valve at the end of the low point drain line have an internal diameter which is greater than the diameter of any vent exhaust orifice.

Another embodiment of a toilet system comprises a toilet bowl having a rim jet annulus located circumferentially inside a portion of a rim disposed above and around the periphery of the toilet bowl wherein the rim jet annulus has a plurality of rim jet orifices for introducing water into the toilet bowl. An annular vent passage is located through a portion of a circumference of the toilet bowl rim and is separate from but circumferentially inside and concentric with the rim jet annulus such that the annular vent passage has a plurality of vent exhaust orifices located at the inner radius of the annular vent passage and above the outer, annular rim jet orifices to avoid communication of water from the plurality of rim jet orifices to the plurality of vent exhaust orifices. The annular vent passage exits the toilet at the back vertical plane of the toilet bowl at an annular exhaust vent line to avoid interference with a water rim jet annulus flow path. The annular exhaust vent line slopes downward from the rear vertical plane of the toilet bowl, and deliberately creates a low point drain location, having a low point drain line tee from the low point drain location of the annular exhaust vent line which extends from the low point drain location to a length which is greater than a water column equivalent to the maximum suction pressure of a vent exhaust fan to ensure positive drainage under all conditions during normal operation, recovery from toilet overflow, and upon completion of back flushing activities. The annular exhaust vent line continues on an upward slope of at least 3 millimeters per 0.3 meter of piping to the rear vertical plane of the toilet where the vent exhaust line is enlarged to continue as a parent exhaust line which is in communication with a bypass branch line upstream of a vent exhaust fan upstream isolation valve located upstream of the vent exhaust fan and the parent exhaust line outlet. The low point drain line and the low point drain valve at the end of the low point drain line have an internal diameter which is greater than the diameter of any vent exhaust orifice. For example the vent exhaust fan of this embodiment is located in the remainder of the parent exhaust line at a minimum elevation greater than a sum elevation of the elevation of the toilet bowl rim plus the maximum suction pressure of the vent exhaust fan, and has a vent exhaust fan upstream isolation valve selected for minimum resistance to ventilation air flow and is located upstream of the vent exhaust fan and wherein the vent exhaust fan is capable of overcoming a capillary effect which may occur after water intrusion into the plurality of vent exhaust orifices, and is of sufficient suction pressure and flow capability to establish desired vent exhaust flow rate through the plurality of vent exhaust orifices even with air flow through the bypass branch line.

In one embodiment, the bypass branch line can be added at the elevation greater than the sum of the elevation of toilet rim plus the maximum suction pressure of the vent exhaust fan, and wherein the bypass branch line tees into the parent exhaust line upstream of the vent exhaust fan upstream isolation valve, and is sized to allow sufficient, continuous ventilation flow for the vent exhaust fan operation under both normal conditions and upset conditions of a toilet overflow or condensate condition blocking ventilation exhaust air flow through the annular vent passage, and is with or without an installed branch line isolation/throttle valve selected to ensure necessary air flow through the vent exhaust fan, and serves as a maintenance connection for back flushing the annular vent passage, vent exhaust orifices, annular exhaust vent line, or parent exhaust line in the event of vent path clogging.

In yet another embodiment a method of venting an odor within a toilet system is provided. An odor within a toilet bowl is vented through a plurality of vent exhaust orifices of an annular vent passage of the toilet bowl. The toilet bowl includes a rim jet annulus located circumferentially inside a portion of a rim disposed above and around the periphery of said toilet bowl wherein the rim jet annulus has a plurality of rim jet orifices for introducing water into the toilet bowl. An annular vent passage which is separate but located circumferentially inside the rim jet annulus of the toilet rim of the toilet bowl. The annular vent passage having the plurality of vent exhaust orifices located at the inner radius of the annular vent passage and positioned above the rim jet orifices to avoid communication of the water from the rim jet orifices into the annular vent passage via the vent exhaust orifices. The annular vent passage connects to an annular exhaust vent line at the back vertical plane of the toilet bowl to avoid interference with the rim jet annulus. The annular exhaust vent line slopes downward from the back vertical plane of the toilet bowl to a low point where there is located a low point drain line and a low point drain valve at the bottom of the low point drain line. From this point, the annular exhaust vent line continues with a constant slope upward for a distance to join with a parent exhaust line wherein the parent exhaust line is in communication with a bypass branch line and a vent exhaust fan upstream isolation valve located upstream of a vent exhaust fan and the parent exhaust line outlet wherein the annular exhaust vent line, the parent exhaust line, the bypass branch line, the exhaust fan upstream isolation valve and vent exhaust fan are above ground. The odor is evacuated through the annular exhaust vent line with the aid of the vent exhaust fan when the fan is creating a suction at the plurality of exhaust orifices of the annular vent passage. In another embodiment a single fan is used to create a suction at the plurality of vent exhaust orifices of the annular vent passage of the toilet when one or more toilets are connected to the same parent exhaust line.

The operation of an embodiment of the present invention under normal conditions of use will be transparent to the user, only requiring exhaust fan operation consistent with current exhaust fan control art. However, an embodiment also accommodates the condition of toilet overflow and condensate buildup anywhere in the vent exhaust path while allowing recovery without equipment damage. Further, embodiments of the invention provide for as-needed maintenance to back flush any portion of the exhaust system in the event of system clogging. The system and method may be applied to a single toilet and exhaust fan or to multiple connected toilets with interconnected vent lines to a common exhaust fan. It is to be understood that the phraseology and terminology employed herein are for the purpose of description and should not be regarded as limiting.

The vent exhaust path may be considered the ventilation flow path comprising the annular vent passage, vent exhaust orifices, annular exhaust vent line, parent exhaust line, including in-line components or any part of this path not otherwise specifically designated. The ventilation flow path communicates fumes from the toilet bowl to a location other than the room where the toilet bowl is located.

Embodiments of the present invention include a toilet having an inner annular vent passage which runs through a portion of the circumference of the toilet bowl rim. The annular vent passage is separate but concentric with the current art liquid flush rim jet annulus such that the vent exhaust orifices are located inside and above the outer, annular rim jet orifices to avoid communication between the vent exhaust orifices of the upper annular vent passage and the liquid rim jet orifices. The annular vent passage is formed integral to the toilet bowl rim and is not therefore flexible. The annular exhaust vent line serves as the annular vent passage exit flow path as the line exits the toilet, and it exits the toilet bowl to avoid interference with the water rim jet annulus flow path. The annular exhaust vent line slopes downward from the toilet bowl rim and deliberately creates a low point drain location. At the low point drain location of the annular exhaust vent line, there is located a low point drain line. The low point drain line extends from this low point to a length which is greater than the water column equivalent to the maximum suction pressure of the vent exhaust fan to ensure positive drainage under all conditions. A low point drain valve is located at the end of the low point drain line and, when open, permits drainage of liquid from condensate buildup during normal operation, upon recovery from a toilet overflow, and upon completion of back flushing operations of the vent exhaust flow path. The annular exhaust vent line continues on an upward slope from the low point to the back vertical plane of the toilet where it would be enlarged to continue as the parent exhaust line.

Embodiments of the present invention include a dedicated vent exhaust fan which is located at a minimum level above the sum elevations of toilet rim plus the maximum suction pressure of the exhaust fan. Upstream of the vent exhaust fan is located a vent exhaust fan upstream isolation valve which will be a gate or ball valve to minimize resistance to flow. If the vent exhaust fan is located at an elevation that will prevent water intrusion during a back flush maintenance activity, an upstream isolation valve may not be necessary. The vent exhaust fan must be capable of overcoming any effect from capillary action which may occur after water intrusion into the annular vent passage and be capable of sufficient flow capability to provide desired vent exhaust flow rate.

An embodiment of the present invention includes a bypass branch line which is upstream of the dedicated vent exhaust fan and upstream of the vent exhaust fan upstream isolation valve (if installed). The bypass branch line must be installed at an elevation greater than the sum of the toilet rim elevation and the maximum suction pressure of the vent exhaust fan. The bypass branch line is sized to allow sufficient, continuous ventilation flow for reliable vent exhaust fan operation even with toilet overflow or condensate condition blocking ventilation exhaust air flow. The bypass branch line may have installed a branch line isolation/throttle valve (globe valve or similar to allow effective throttling) to ensure vent exhaust fan flow under all conditions. The bypass branch line serves as a maintenance connection for back flushing the vent exhaust path if clogging ever were to occur.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

As used herein "a" or "an" or "the" means one or more.

Figure 1A:
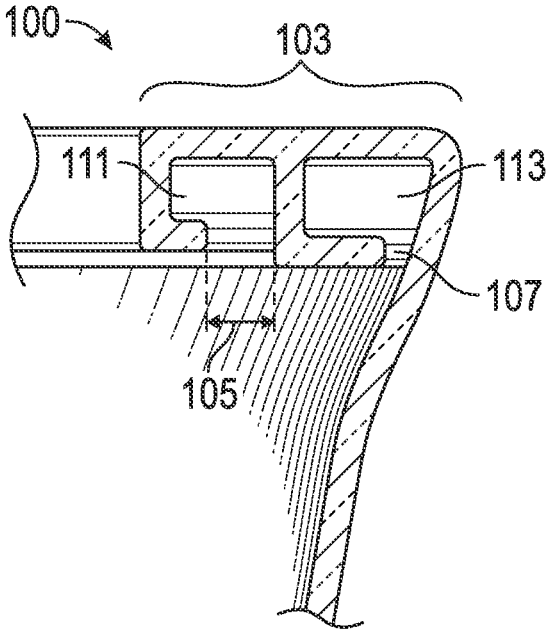
FIG. 1A and FIG. 1B illustrate cross sectional views of the toilet rim according to embodiments of the present invention.
Figure 1B:
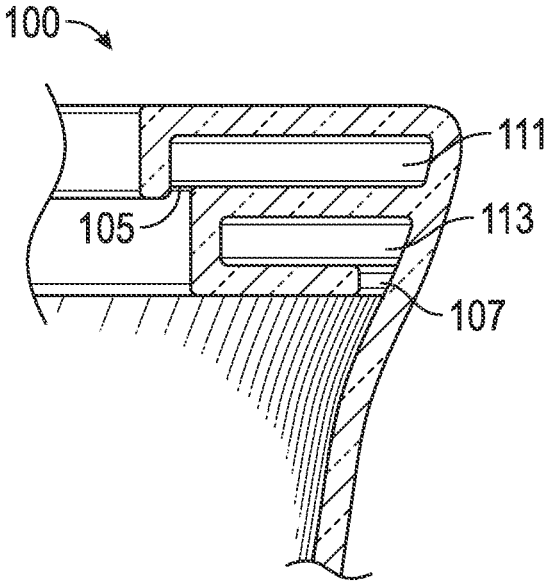

Referring now to FIGS. 1A and 1B, FIGS. 1A and 1B depict cross-section views of the toilet bowl rim 103 according to two embodiments of the present invention. In FIG. 1A the vent exhaust orifices 105 of the ventilation exhaust path are located in the inner radius of the annular vent passage 111 which is circumferentially inside the rim jet annulus 113, and the vent exhaust orifices 105 are located above the existing rim jet orifices 107 of the rim jet annulus 113 to avoid water intrusion during normal operation. In FIG. 1B the vent exhaust orifices 105 of the ventilation exhaust path are located in the inner radius of the annular vent passage 111 which is concentric with but predominantly above the rim jet annulus 113, and the vent exhaust orifices 105 are located above the existing rim jet orifices 107 of the rim jet annulus 113 to avoid water intrusion during normal operation. In the FIG. 1B embodiment, the outer, circumferential wall of the annular vent passage shares the toilet bowl wall with the rim jet annulus at the rim of the toilet bowl. These vent exhaust orifices 105 are in communication with the balance of the ventilation exhaust path (i.e., annular vent passage, annular exhaust vent line, and parent exhaust line). Wall thickness for each toilet bowl wall of any embodiment of this invention would continue to be similar to the current art to ensure structural integrity during normal use but is not limited thereto as the system could work with custom toilets having non-traditional toilet bowl wall thickness.

Figure 2:
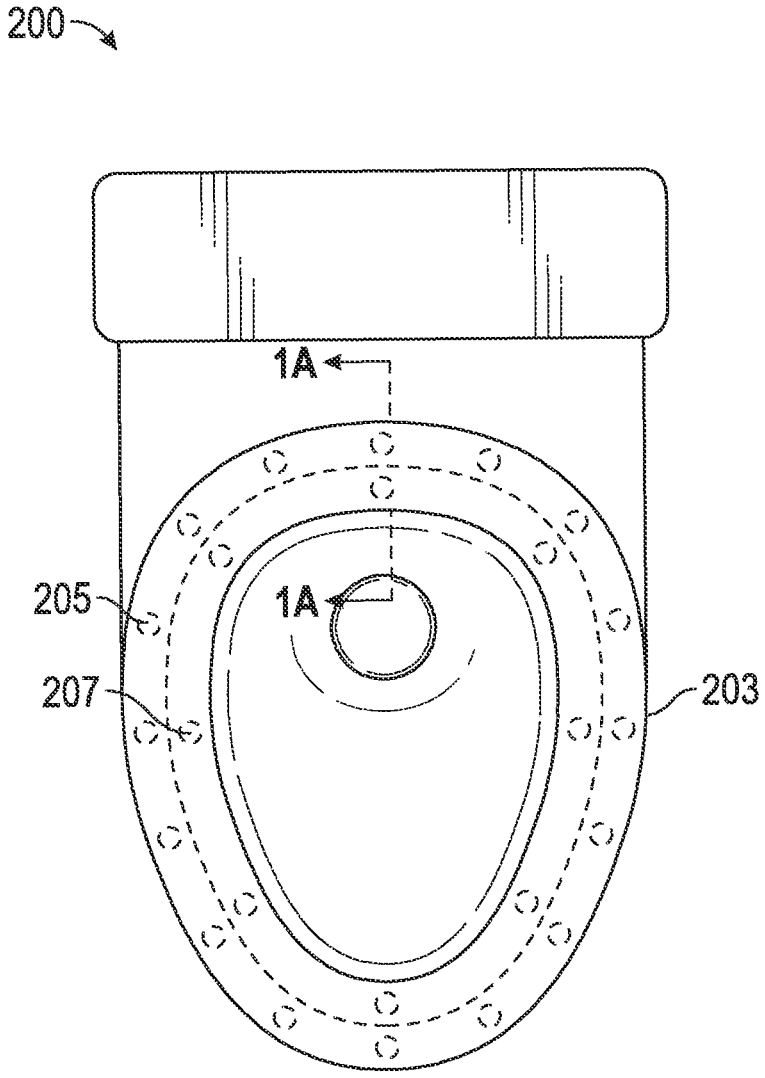
FIG. 2 is a top view of the toilet bowl rim according to one embodiment illustrating the relative numbers and locations of the current art rim jet orifices and the proposed vent exhaust orifices of the present invention.

Referring now to FIG. 2, a plan view embodiment of the toilet bowl rim 203 showing the relative number and location of the existing rim jet orifices 205 and the vent exhaust orifices 207 according to one embodiment of the present invention is illustrated. The size and number of the vent exhaust orifices may vary, depending on the suction pressure capability of the vent exhaust fan and desired vent exhaust flow rate. Cross section 1A of the toilet bowl rim is illustrated in FIG. 1A with an alternate embodiment illustrated in FIG. 1B.

Figure 3A:
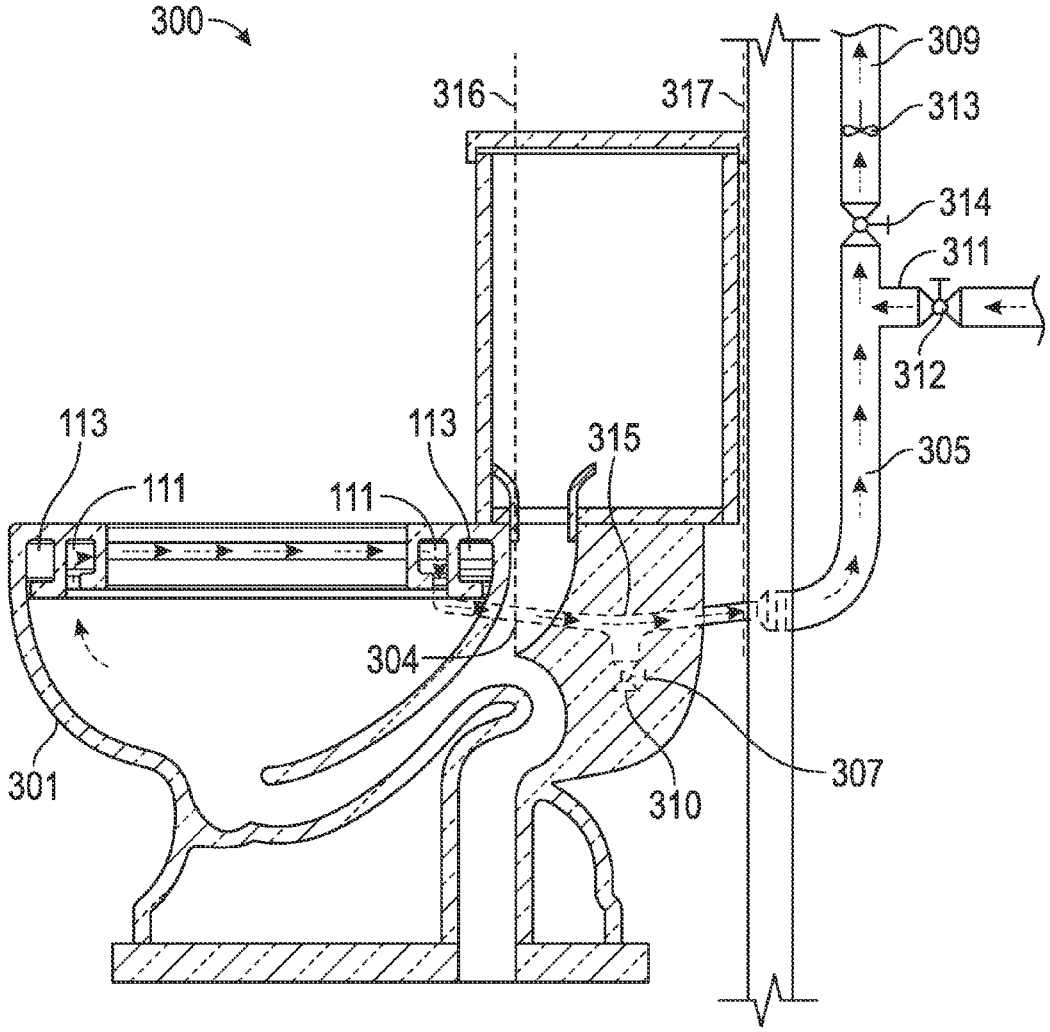
FIG. 3A and FIG. 3B illustrate two different embodiments of the complete toilet/exhaust system present invention.
Figure 3B:
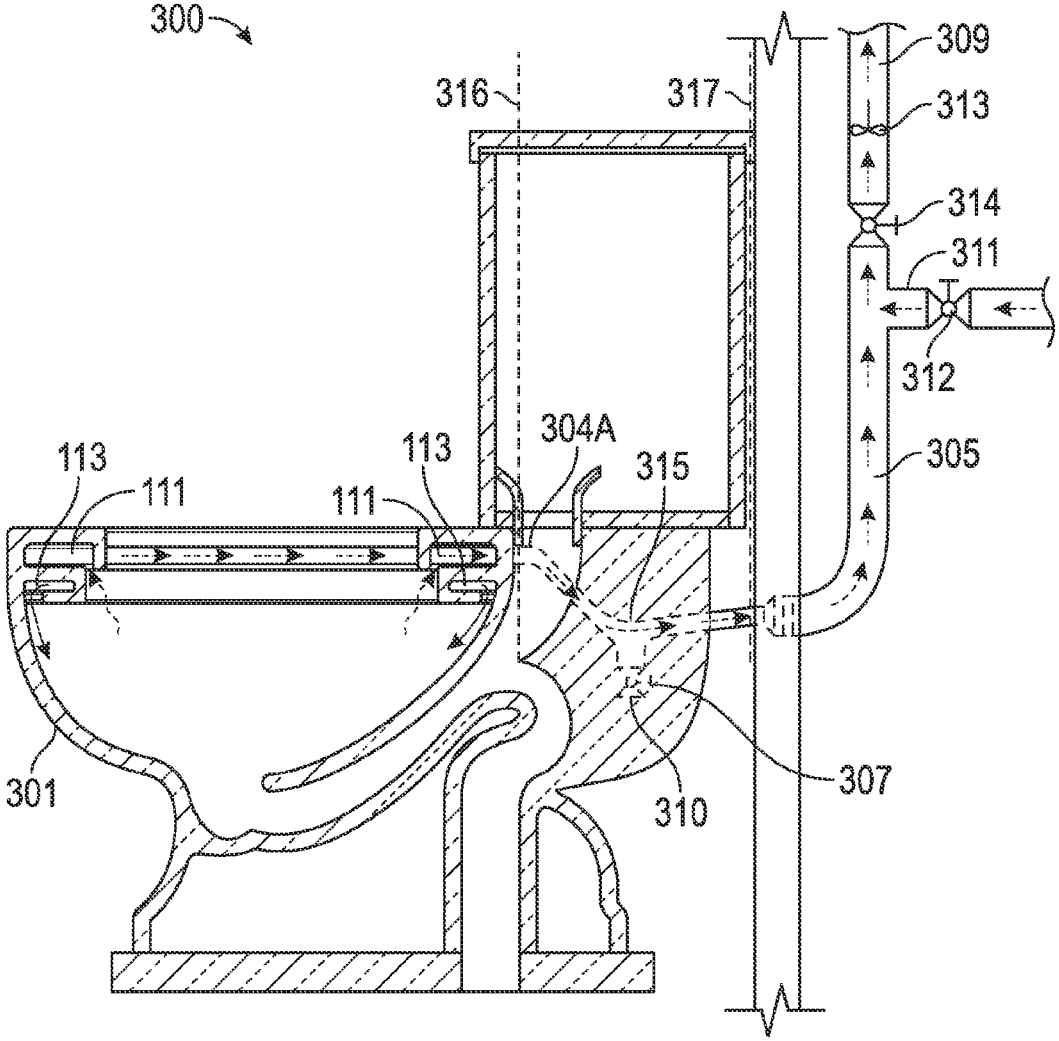

Referring now to FIGS. 3A and 3B (associated with FIGS. 1A and 1B, respectively) show side view embodiments of the toilet 300 with the location of the annular exhaust vent line 315 leading from the annular vent passage 111 upon exiting at the back vertical plane 316 of the toilet bowl 301 and molded into the toilet body and connecting to the parent exhaust line 305. The low point drain line 307, low point drain valve 310, and the constant slope upward of the annular exhaust vent line from the low point to the back vertical plane 317 of the toilet are illustrated. The exhaust path is illustrated by the dotted arrows. The vent exhaust fan 313 is positioned between the parent exhaust line outlet 309 and the vent exhaust fan upstream isolation valve 314. The vent exhaust fan upstream isolation valve is a valve which offers little head loss (e.g., ball valve or gate valve). Further upstream of the vent exhaust fan upstream isolation valve is located a bypass branch line 311 which tees off the parent exhaust line 305 at a minimum elevation greater than the sum of the elevation of the toilet rim plus the maximum suction pressure of the vent exhaust fan. In the bypass branch line is a branch line isolation/throttle valve 312 (e.g., globe valve) which may be used for throttling of air flow or for throttling or isolating liquid flow for maintenance back flush operations. The branch line isolation/throttle valve may be present in either embodiment described in FIGS. 1A and 1B. The manner in which the annular exhaust vent line exits the toilet bowl rim in the system may vary in the two embodiments. In FIG. 3A, the embodiment of the annular exhaust vent line exits the toilet bowl rim below the toilet rim from inside the bowl at position 304. In FIG. 3B, the embodiment of the annular exhaust vent line exits the upper part of the toilet rim outside of the toilet bowl 301 and at the same elevation as the annular vent passage at position 304A.

Figure 4A:
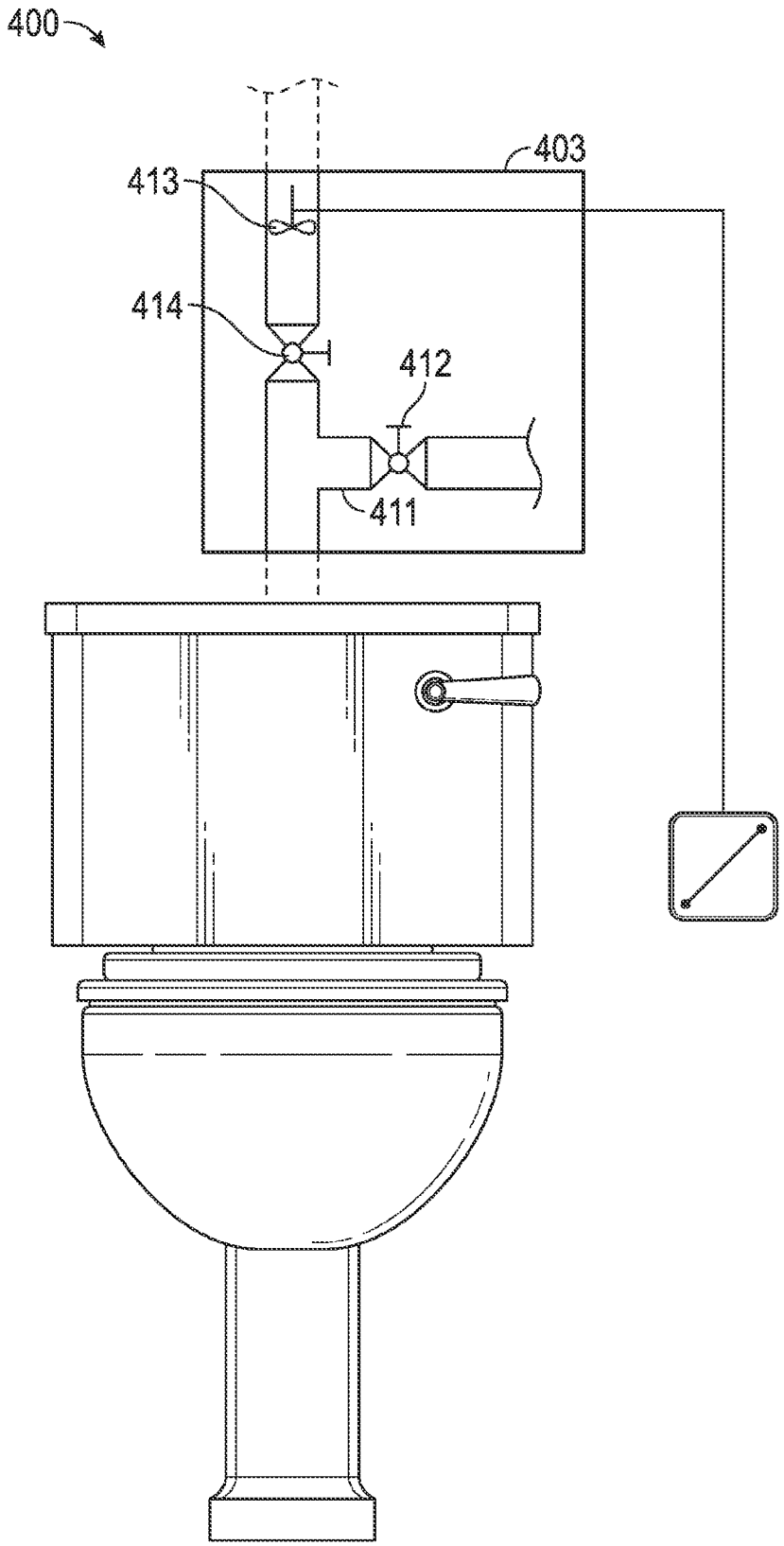
FIG. 4A and FIG. 4B illustrate two embodiments of the utility box configurations housing the bypass branch line and other components.
Figure 4B:
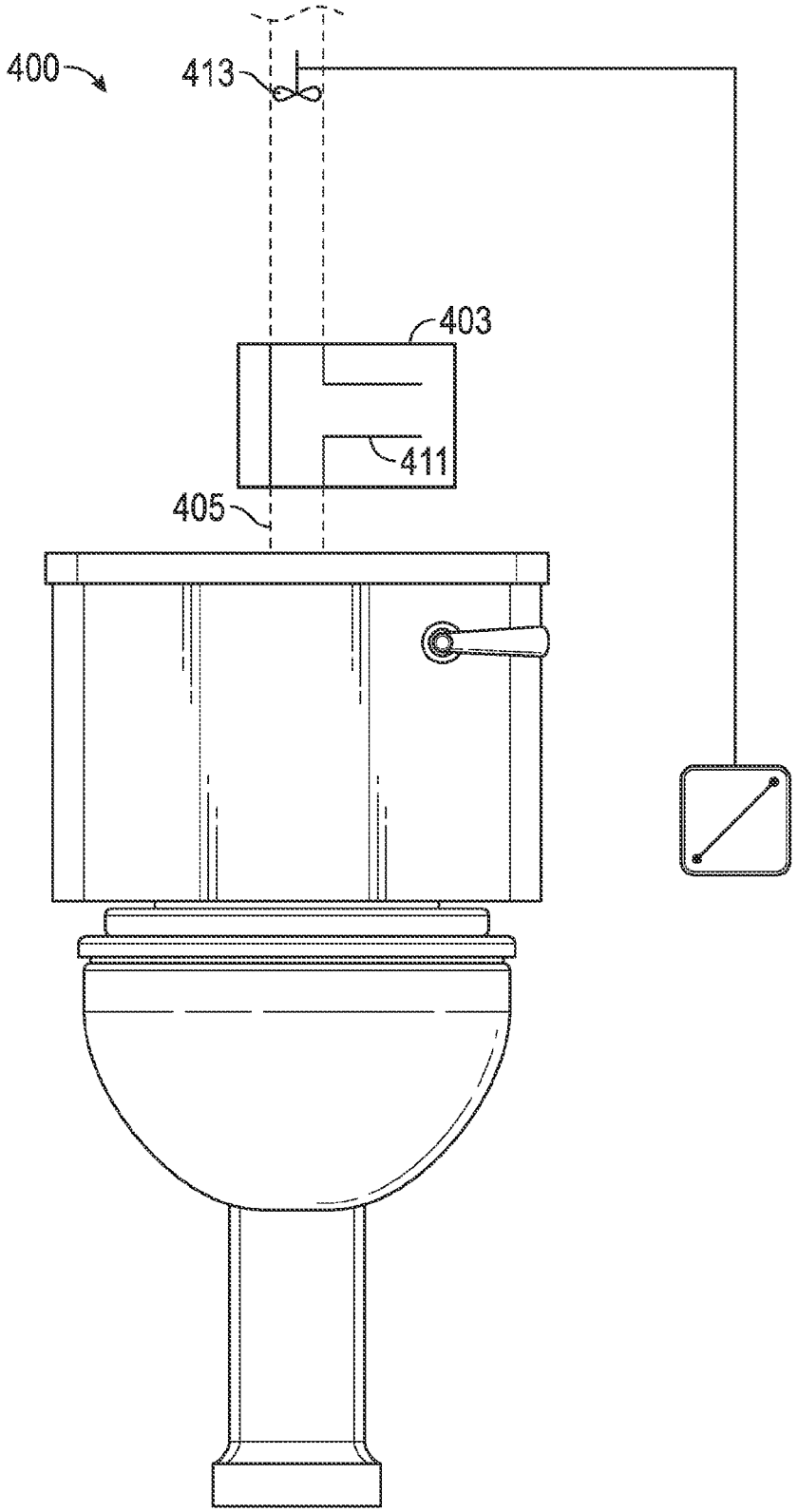

Referring now to FIG. 4A the installation of the vent exhaust fan 413 (with conventional on/off and/or proximity switch), the vent exhaust fan upstream isolation valve 414, the bypass branch line 411, and the branch line isolation/throttle valve 412 are illustrated according to one embodiment of the present invention. The bypass branch line and the branch line isolation/throttle valve exist to ensure continued vent exhaust fan flow even with toilet overflow or condensate buildup. This will prevent damage to the vent exhaust fan under upset conditions when there is no flow through the annular vent passage. FIG. 4B illustrates the installation of the vent exhaust fan at a significantly higher elevation (not to scale) than the other components, without a vent exhaust fan upstream isolation valve or a branch line isolation/throttle valve but with the bypass branch line according to another embodiment of the present invention. The utility box 403 is illustrated in FIGS. 4A and 4B. In FIG. 4A the utility box includes the vent exhaust fan 413, bypass branch line 411 with branch line isolation/throttle valve 412, and the vent exhaust fan upstream isolation valve 414. In FIG. 4B the louvered utility box is in the same relative location but with the vent exhaust fan at a higher elevation, no vent exhaust fan upstream isolation valve and the bypass branch line without a branch line isolation/throttle valve.

Any combination of the embodiments depicted in FIGS. 4A and 4B may be employed, depending on the intended approach to maintenance activities.

Figure 5:
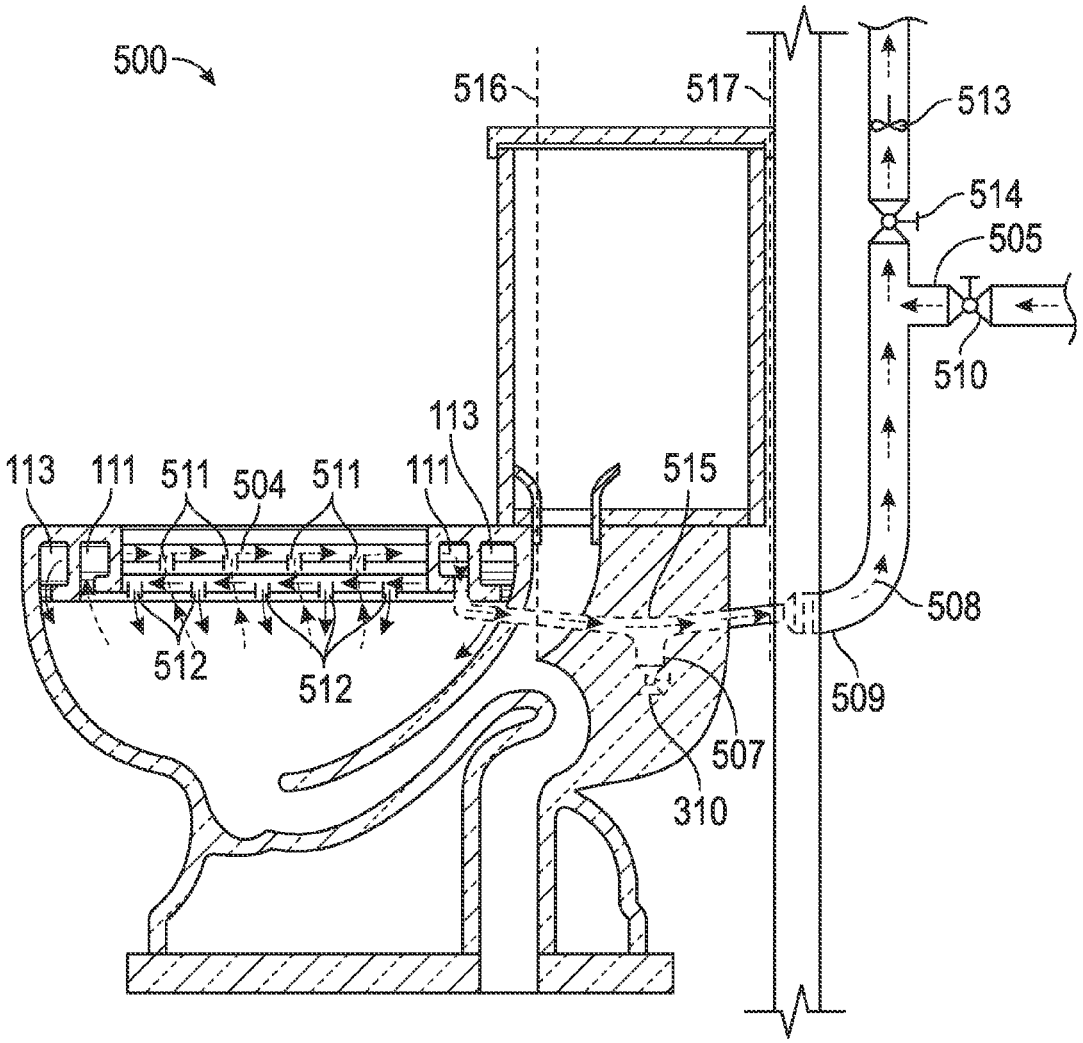
FIG. 5 is a view of the toilet exhaust system according to one embodiment of the present invention.

Referring now to FIG. 5 the flow path of the ventilation exhaust from the toilet rim as it enters through the vent exhaust orifices 511, travels through the ventilation exhaust annulus 504, out the rear vertical plane 516 of the toilet bowl, as the annular exhaust vent line 515 to the low point drain line 507, through the upwardly sloped portion of the annular exhaust vent line, to the enlarged connection 509 at the rear vertical plane 517 of the toilet, and up through the parent exhaust line 508, vent exhaust fan upstream isolation valve 514, through the vent exhaust fan 513 and to the outside according to one embodiment of the present invention. Some ventilation flow also will exist through the bypass branch line 505 during vent exhaust fan operation to protect the fan against no-flow conditions.

One embodiment of the present invention consists of a standard toilet configuration but with an annular vent passage 111 and vent exhaust orifices 511 integral to the toilet bowl rim. The annular exhaust vent line 515 exits the toilet bowl so as not to interfere with the current art liquid flushing configuration. The vent exhaust orifices 511 would be located above and radially inside the current rim jet orifices 512. This would prevent any water intrusion into the vent exhaust orifices during the normal flushing operation of the toilet. The annular exhaust line may exit the bowl through an opening at the rear vertical plane 516 of the toilet bowl. The continuing annular exhaust vent line will unavoidably slope downward from the toilet bowl rim and, therefore, create a low point where collection of liquid would occur due to toilet overflow or condensation. This location would serve as the low point drain for the vent exhaust system. At this low point location there would be installed a tee-off low point drain line 507 from the annular exhaust vent line. To ensure positive drainage of the annular exhaust vent line and the parent exhaust line 508 under all conditions, this drain line length is greater than the height of the water column equivalent to the maximum suction pressure possible from the vent exhaust fan. The low point drain line 507 would have a petcock or other type of valve 310 installed at the bottom of the low point drain line. If exhaust ventilation flow is ever interrupted by toilet overflow or by collection of condensation, this low point drain valve may be opened to drain all liquid from the exhaust line even with continued vent exhaust fan operation. Alternatively, the low point drain valve could be left open for normal operation and closed only for vent line back flushing during maintenance as discussed further below. The low point drain valve would be closed for maintenance back flushing and open to drain the vent exhaust path upon completion of flushing operations.

From the low point drain line 507 in the annular exhaust vent line 515, the annular exhaust vent line must continue on an upward slope to the connecting vertical portion of the parent exhaust line 508 in which will be located the vent exhaust fan upstream isolation valve 514 and the vent exhaust fan 513. To avoid fragility and to add to the aesthetics of the toilet, it is preferred to mold the annular exhaust vent line integral with the existing body mold of the toilet for that portion of the annular exhaust vent line which is upstream the rear vertical plane 517 of the toilet. However, the annular exhaust vent line upstream the rear vertical plane 517 of the toilet may be created with materials and components that are not integral to the toilet mold. An upward slope of at least 3 millimeters per 0.3 meters of piping from the low point drain line must be maintained as the annular exhaust vent line and the parent exhaust line continue to the vent exhaust fan 513. To ensure adequate vent exhaust flow, the size of the annular exhaust vent line 515 and the parent exhaust line 508 would need to be matched appropriately with the performance capability of the vent exhaust fan 513. The annular exhaust vent line 515 would exit the rear vertical plane of the toilet 517, connect with the enlarged connection 509 of the parent exhaust line 508, and enter the wall. The enlarged connection may be made with an 0-ring seal, threaded, glued fitting, hose clamp, or any other connecting type device and using either flexible or rigid piping from any of a number of material types. Enlarging the parent exhaust line would be advised to reduce the head loss in the exhaust line and increase the vent exhaust flow rate. The parent vent line would continue to the vent exhaust fan 513 and discharge to the outside or to a means to deodorize and return the air. The vent exhaust fan inlet must be located above a minimum height equal to the sum of the level of the toilet rim plus the equivalent water column expected from the maximum suction pressure of the vent exhaust fan. That is, the vent exhaust fan is not located below the toilet bowl rim.

Operation of the vent exhaust fan would be controlled with a standard on/off wall switch or a proximity switch and power source as employed in current art. An optional embodiment is to appoint the vent exhaust fan with a rheostat controller to allow adjustment of the vent exhaust fan flow rate. The rheostat control of the vent exhaust fan also is current art.

A bypass branch line 505 would be installed at a minimum elevation greater than the sum elevation of the toilet rim plus the maximum suction pressure of the vent exhaust fan 513 and installed upstream of the vent exhaust fan upstream isolation valve 514. The bypass branch line 505 is installed to provide a bypass flow capability such that a no-flow condition for the vent exhaust fan 513 would never occur, even with toilet overflow or condensate buildup blocking flow from the upstream portion of the vent exhaust path. This bypass branch line also would serve as the maintenance connection for back flushing of the exhaust system. To ensure the bypass flow is properly matched with the fan capabilities while maintaining adequate exhaust ventilation flow, the bypass branch line 505 may or may not include a branch line isolation/throttle valve 510.

To accommodate back flush maintenance of the vent exhaust orifices 512, the annular vent passage 504, the annular exhaust vent line 515, the parent exhaust line 508, and a vent exhaust fan upstream isolation valve 514 (one such as a gate valve or ball valve to reduce head losses) may be installed upstream of the vent exhaust fan 513. The vent exhaust fan upstream isolation valve 514 would be open during normal operation and shut only during maintenance back flushing. The vent exhaust fan upstream isolation valve 514 would serve to prevent water intrusion into the vent exhaust fan inlet during maintenance back flushing operations.

Another embodiment would be to raise the vent exhaust fan to a higher elevation to preclude the need for a vent exhaust fan upstream isolation valve. This embodiment would be appropriate so long as the pressure source of fluid for back flush operations would not exceed the equivalent water column height to the vent exhaust fan inlet. This arrangement also would avoid water intrusion into the vent exhaust fan inlet during maintenance back flushing operations.

To avoid a potentially damaging no-flow condition for the vent exhaust fan, the vent exhaust fan would be turned OFF during back flushing activities when a single vent exhaust fan exhausts a single toilet. Turning off the vent exhaust fan may not be necessary if the vent exhaust fan exhausts multiple toilets as sufficient flow may be available from the other vent exhaust paths even as flow is completely isolated from one toilet during the back flushing operation or resulting from toilet overflow or condensate buildup in the vent exhaust system of an individual toilet.

Any combination of the arrangements described in paragraphs [0042], [0043], and [0044] may be employed, depending on the intended approach to back flush maintenance capabilities.

For convenience and accessibility, the vent exhaust fan, the vent exhaust fan upstream isolation valve (if installed), the bypass branch line, and branch line isolation/throttle valve (if installed) may be installed in a louvered connection box integral to the back wall. This connection box must be louvered to permit flow through the bypass branch line.

The phenomenon of capillary action must be considered. Capillary action would occur if water were to be introduced into the vent exhaust orifices. Capillary action results in a residual water column in each orifice even after normal drainage, the water column level dictated by the individual radius of the vent exhaust orifices. The suction pressure of the vent exhaust fan must be adequate to overcome the resulting water column so vent exhaust flow can be reestablished and maintained after the vent exhaust orifices are flooded. Therefore, proper vent exhaust orifice sizing for adequate vent exhaust flow as well as for consideration of capillary action must be determined to be compatible with the vent exhaust fan performance specifications (i.e., its fan performance curve).

Use of a positive displacement exhaust driver instead of a common exhaust fan would negate the innate features of this invention which avoid equipment damage and ensure effective vent line drainage after a toilet overflow, condensate buildup, or post maintenance back flush condition. Also, a vent exhaust fan, contrary to a positive displacement or high pressure ventilation mechanism, would have a relatively low suction pressure so that the suction force would do little to cause any debris to clog the vent exhaust orifices, annular vent passage, annular exhaust vent line, or parent exhaust line. These design attributes of this invention make it easy for the maintenance back flush operation to clear any obstructions and restore toilet exhaust ventilation.

The internal vent exhaust path according to an embodiment of the proposed invention will more effectively and more efficiently contain and remove toilet gases with less required energy and in less time than the current art. The use of a dedicated vent exhaust fan would reduce energy consumption without sacrifice to efficiency or effectiveness. A dedicated vent exhaust fan or a vent exhaust fan of shared use may be placed on a rheostat so that vent exhaust fan flow rate could be adjusted according to need. However, at all times the suction pressure of the vent exhaust fan must be adequate to meet the vent exhaust flow requirements and overcome any concerns associated with capillary action.

In a preferred embodiment of the present invention, a toilet comprises a toilet bowl with an upper rim which includes a separate, integrally-molded inner circumferential, annular vent passage with multiple vent exhaust orifices in number and size to be compatible with vent exhaust flow needs and the vent exhaust fan performance specifications. The annular vent passage connects to the annular exhaust vent line at the rear vertical plane of the toilet bowl and would be molded into the body of the toilet and would slope downward to the low point drain line as it exits the toilet bowl and then slope continuously upward from the low point drain line toward the back of the toilet. At the bottom of the low point drain line, a low point drain isolation valve is located. The low point drain line would be of adequate length to drain the parent exhaust line even during exhaust fan operation. Therefore, the length of the drain line must be greater than the maximum suction pressure capability of the vent exhaust fan. The properly sized annular exhaust vent line follows the contour of the toilet mold as it slopes upward to the rear of the toilet. At this point the annular exhaust vent line connects to the enlarged parent exhaust line. This connection would be made using any of the various means discussed previously. The parent exhaust line will continue to the vent exhaust fan which will be preceded by the vent exhaust fan inlet isolation valve (gate valve or equivalent for minimizing head loss). The vent exhaust fan upstream isolation valve for the vent exhaust fan could be excluded if the vent exhaust fan is installed at an elevation that would exceed the equivalent elevation of the head pressure from any back flushing source of fluid. Upstream of the vent exhaust fan upstream isolation valve would be connected a bypass branch line properly sized with or without an in-line branch line isolation/throttle valve to ensure reliable vent exhaust fan operation under all conditions without damaging the vent exhaust fan. The bypass branch line would be installed at a minimum elevation greater than the sum elevation of the toilet rim plus the maximum suction pressure of the vent exhaust fan and installed upstream of the vent exhaust fan upstream isolation valve (if installed). The vent exhaust fan outlet will be connected to the continuing parent exhaust line and vent to the outside.

Although the invention has been described in detail with particular reference to these preferred embodiments, other embodiments can achieve the same results. Variations and modifications of the present invention will be obvious to those skilled in the art, and it is intended to cover in the appended claims all such modifications and equivalents. The entire disclosures of all references, applications, patents, and publications cited above are hereby incorporated by reference.

The invention claimed is:

1. A toilet system comprising:

a toilet bowl having a rim jet annulus located circumferentially inside a portion of a toilet rim disposed above and around a periphery of the toilet bowl wherein the rim jet annulus has a plurality of rim jet orifices for introducing water into the toilet bowl;

an annular vent passage which is separate but located circumferentially inside and concentric with the rim jet annulus of the toilet rim of the toilet bowl, the annular vent passage having a plurality of vent exhaust orifices located at an inner radius of the annular vent passage and positioned above the rim jet orifices to avoid communication of water from the plurality of rim jet orifices into the annular vent passage via the plurality of vent exhaust orifices; and the annular vent passage connecting at the back vertical plane of the toilet bowl to avoid interference with the rim jet annulus, to an annular exhaust vent line wherein the annular exhaust vent line slopes downward from the back vertical plane of the toilet bowl to a low point where there is located a low point drain line and a low point drain valve at the bottom of the low point drain line, thereafter, the annular exhaust vent line continues with a constant slope upward for a distance to join with an enlarged parent exhaust line wherein the parent exhaust line is in communication with a bypass branch line upstream of a vent exhaust fan upstream isolation valve located upstream of a vent exhaust fan and the parent exhaust line outlet.

2. The system of claim 1 wherein the annular vent passage is predominantly located above the existing rim jet annulus.

3. The system of claim 1 wherein the bypass branch line tees off the parent exhaust line upstream of the vent exhaust fan upstream isolation valve and at a minimum elevation more than the sum elevations of the toilet rim plus the maximum suction pressure of the vent exhaust fan.

4. The system of claim 1 wherein the bypass branch line further comprises a branch line isolation/throttle valve which may be used for throttling of air flow or for throttling or isolating liquid flow for maintenance back flush operations.

5. The system of claim 1 wherein the bypass branch line does not include a branch line isolation/throttle valve.

6. The system of claim 1 wherein the annular exhaust vent line exits the toilet bowl at a same elevation as the annular vent passage or exits the toilet bowl below the toilet rim from inside the toilet bowl to avoid interference with the rim jet annulus flow path.

7. The system of claim 1 wherein the low point drain line located at the low point of the annular exhaust vent line extends to a length which is greater than the height of a water column equivalent to the maximum suction pressure possible from the vent exhaust fan to ensure positive drainage under all use conditions, and the low point drain line and the low point drain valve at the end of the low point drain line have an internal diameter which is greater than a diameter of any vent exhaust orifice.

8. The system of claim 1 wherein the constant slope of the annular exhaust vent line and parent exhaust line is at least 3 millimeters per 0.3 meters of piping from the low point drain line.

9. The system of claim 1 wherein the bypass branch line is sized to allow sufficient and continuous ventilation flow for the vent exhaust fan under normal and upset conditions, and to maintain exhaust flow through the vent exhaust orifices with the bypass flow, and to serve as a maintenance access connection for back flushing the parent exhaust line, annular vent passage, and vent exhaust orifices.

10. The system of claim 1 wherein the plurality of vent exhaust orifices are sized in consideration for vent exhaust flow and capillary action consistent with the vent exhaust fan.

11. The system of claim 1 wherein a single fan is used to create a suction at the plurality of vent exhaust orifices of the annular vent passage of the toilet when one or more toilets are connected to a same parent exhaust line.

12. The system of claim 1 wherein the vent exhaust fan is located in the parent exhaust line outlet at a minimum elevation greater than a sum elevation of the elevation of the toilet rim plus a maximum suction pressure of the vent exhaust fan, and is of sufficient suction pressure and flow capability to establish desired vent exhaust flow rate through the plurality of vent exhaust orifices even with air flow through the bypass branch line.

13. A method of venting an odor within a toilet system comprising:

venting through a plurality of exhaust orifices of an annular passage an odor within a toilet bowl, the toilet system comprising:

a rim jet annulus located circumferentially inside a portion of a toilet rim disposed above and around the periphery of the toilet bowl wherein the rim jet annulus has a plurality of rim jet orifices for introducing water into the toilet bowl;

an annular vent passage which is separate but located circumferentially inside and concentric with the rim jet annulus of the toilet rim of the toilet bowl, the annular vent passage having the plurality of vent exhaust orifices located at the inner radius of the annular vent passage and positioned above the rim jet orifices to avoid communication of the water from the plurality of rim jet orifices into the annular vent passage via the plurality of vent exhaust orifices; and the annular vent passage connecting at a back vertical plane of the toilet bowl to avoid interference with the rim jet annulus to an annular exhaust vent line which slopes downward from the back vertical plane of the toilet bowl to a low point where there is located a low point drain line and a low point drain valve at the bottom of the low point drain line, thereafter, the annular exhaust vent line continues with a constant slope upward for a distance to join with a parent exhaust line wherein the parent exhaust line is in communication with a bypass branch line and a vent exhaust fan upstream isolation valve located upstream of a vent exhaust fan and the parent exhaust line outlet wherein the annular exhaust vent line, the parent exhaust line, the bypass branch line, the exhaust fan upstream isolation valve and vent exhaust fan are above ground; and evacuating the odor through the annular exhaust vent line with the aid of the vent exhaust fan when the fan is creating a suction at the plurality of exhaust orifices of the annular vent passage.

14. The method of claim 13 wherein a single fan is used to create a suction at the plurality of vent exhaust orifices of the annular vent passage of the toilet when one or more toilets are connected to a same parent exhaust line.

* * * * *